United States Patent [19]

Yamazaki et al.

[11] 4,205,985

[45] Jun. 3, 1980

[54] NICKEL BASE ALLOY

[75] Inventors: Michio Yamazaki, Zushi; Hiroshi Harada, Tokyo, both of Japan

[73] Assignee: National Research Institute for Metals, Tokyo, Japan

[21] Appl. No.: 936,503

[22] Filed: Aug. 24, 1978

[30] Foreign Application Priority Data

Mar. 2, 1978 [JP] Japan ..... 53-22853
Mar. 2, 1978 [JP] Japan ..... 53-22854
Mar. 2, 1978 [JP] Japan ..... 53-22855

[51] Int. Cl.[2] ..... C22C 19/05

[52] U.S. Cl. ..... 75/171

[58] Field of Search ..... 75/171, 170; 148/32, 148/32.5

[56] References Cited

U.S. PATENT DOCUMENTS 3,164,465 1/1965 Thielemann ..... 75/171
3,293,030 12/1966 Child et al. ..... 75/171

*Primary Examiner*—R. Dean
*Attorney, Agent, or Firm*—Wenderoth, Lind & Ponack

[57] ABSTRACT

Nickel-base alloys having superior creep strength and resistance to hot corrosion are disclosed.

5 Claims, 1 Drawing Figure

NICKEL BASE ALLOY

Figure 1:
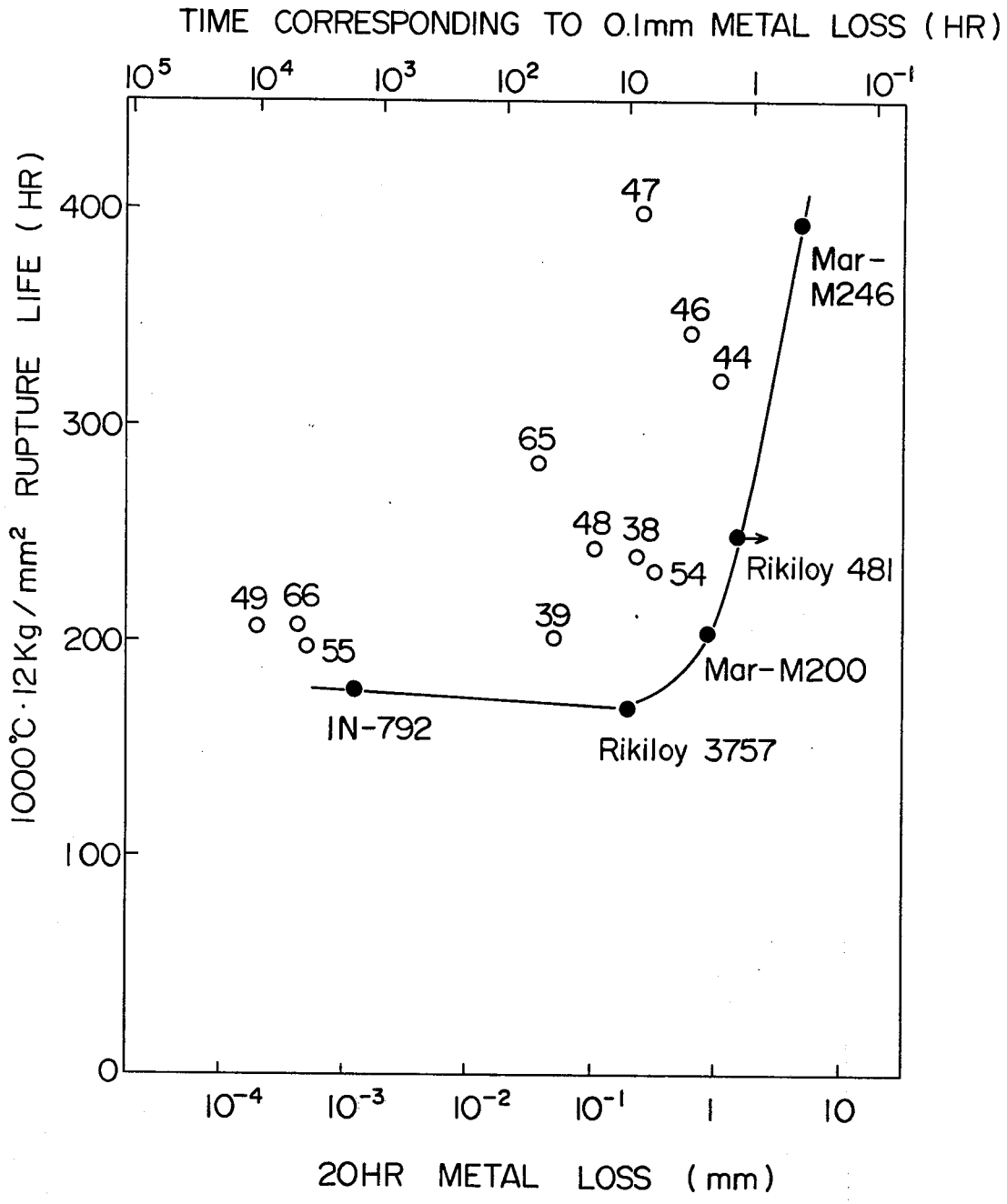

This invention relates to novel nickel-base alloys having superior creep strength and resistance to hot corrosion (sulfidation).

Elevating the temperature of a burning gas is considered to be most effective for increasing the output and thermal efficiency of gas turbines used in airplanes or power generating plants. For this purpose, the development of blade materials having superior creep strength and hot corrosion resistance is required. Furthermore, a combined cycle power generating system has been planned in which a gas turbine is operated at higher temperatures, and a steam turbine is operated by the exhaust heat from the gas turbine. Consequently, the requirements for materials of blades have become more rigorous.

Nearly all materials now in use as blades of various gas turbines are nickel-base alloys including many elements. Among them, typical nickel-base alloys having high creep resistance are Mar-M200 and Mar-M246 (both trademarks of Martin Marietta Corporation, U.S.A.) and Rikiloy 481 (a trademark of Hitachi Metal Co., Ltd., Japan). On the other hand, typical nickel-base alloys having good hot corrosion resistance are IN-792 (a trademark of International Nickel Corporation, U.S.A.) and Rikiloy 3757 (a trademark of Hitachi Metal Co., Ltd., Japan). The first three alloys cited have a good creep strength, but poor resistance to hot corrosion. The last two alloys have good resistance to hot corrosion, but comparatively low creep strength. Thus, creep strength and hot corrosion resistance exhibit contradictory tendencies in nickel-base alloys, and it is very difficult to obtain alloys which simultaneously possess these two desirable properties. Generally, nickel-base alloys having high creep strength have a relatively small Cr content, and those having good resistance to hot corrosion have a high Cr content. It has now been found by the inventors that not only the Cr content but also the proportions of other constituents in the alloy, interacting complicatedly, affect the two desirable properties. According to the present invention, the three types of nickel-base alloys to be described below realize satisfactory creep strength and hot corrosion resistance at the same time. The use of the alloys of this invention as materials for blades of various gas turbines in jet engines, power generating plants, etc. makes it possible to elevate the temperature of burning gases and to increase the output and thermal efficiency.

FIG. 1 shows the creep strengths and hot corrosion resistances of nickel-base alloys of the invention and the typical conventional nickel-base alloys.

A first type nickel-base alloy of this invention consists essentially of C 0.2–1.0%, Cr 12–16.5%, Co 2–13%, W 1.5–3.6%, Ti 2.5–8%, Ta 0.1–2.0%, Al 6–11.5%, B 0.03–0.12%, Zr 0.01–0.10%, and the remainder being Ni, wherein $Cr\% + 0.6\ Ti\% \geqq 16\%$, $Ta\% + W\% + 0.5Ti\% = 3.5–7.5\%$, and $Al\% + Ti\% + Ta\% = 11.5–16\%$, all percentages being atomic %.

The proportions of the constituents of alloys in the present application are in atomic %.

The limitations of the proportions of the alloy constituents to these ranges have been set for the following reasons.

As is well known, C forms three types of carbides, MC, $M_{23}C_6$ and $M_6C$ (M represents a metal), to strengthen mainly the grain boundary of the crystals of the alloy. To obtain this effect sufficiently from the alloy of this invention, the proportion of C must be at least 0.2%. If, however, it is more than 1.0%, a large amount of coarse particles of an MC-type carbide crystallizes out to cause a reduction in creep strength. Hence, the content of C has been limited to 0.2–1.0%.

Cr greatly increases hot corrosion resistance, and dissolves in a large amount in the $\gamma$-phase of the alloy to serve for the solid solution hardening of the $\gamma$-phase. To obtain this effect from the alloy of this invention, Cr must be included in an amount of at least 12%. If its amount exceeds 16.5%, a $\sigma$-phase which is an intermetallic compound, forms to reduce the creep strength of the alloy. Accordingly, the proportion of Cr has been limited to 12–16.5%.

Co dissolves in the $\gamma$-phase and the $\gamma'$-phase stoichiometrically expressed by $Ni_3Al$ to serve for the solid solution hardening of these phases, and also increases the amount of precipitate of the $\gamma'$-phase in the $\gamma$-phase to promote the precipitation hardening of the $\gamma$-phase. To obtain this effect from the alloy of this invention, the proportion of Co should be at least 2%. If it exceeds 13%, a detrimental precipitate such as the $\sigma$-phase appears to reduce the creep strength of the alloy. Accordingly, the amount of Co has been limited to 2–13%.

W dissolves in the $\gamma$-phase and $\gamma'$-phase to cause the marked solid solution hardening of these phases. To obtain this effect, the proportion of W should be at least 1.5%. If it exceeds 3.6%, the hot corrosion resistance of the alloy is reduced, and a detrimental precipitate such as the $\sigma$-phase forms. Accordingly, the proportion of W has been limited to 1.5-3.6%.

Ti mostly dissolves in the $\gamma'$-phase to serve for the marked solid solution hardening of the $\gamma'$-phase, and also increases the amount of the $\gamma'$-phase to contribute to the precipitation hardening of the $\gamma'$-phase. It is also effective for improving hot corrosion resistance. To obtain these effects with the alloy of this invention, the amount of Ti must be at least 2.5%. If it eceeeds 8%, the fluidity of the molten alloy at the time of casting is aggravated, and detrimental intermetallic compounds such as the $\eta$-phase or $\sigma$-phase form. Accordingly, the content of Ti has been limited to 2.5–8%.

Ta mostly dissolves in the $\gamma'$-phase to contribute greatly to solid solution hardening, and at the same time, increases the amount of the $\gamma'$-phase to contribute to precipitation hardening. If, however, the amount of Ta exceeds 2%, the hot corrosion resistance of the alloy becomes poor, and a detrimental intermetallic compound such as the $\sigma$-phase forms. Accordingly, the content of Ta has been limited to not more than 2%. The lower limit is 0.1%.

Al is an element necessary for forming the $\gamma'$-phase. It should be included in an amount of at least 6% for sufficient precipitation hardening of the alloy. If the amount exceeds 11.5%, the amount of eutectic $\gamma'$-phase which deposits from liquid becomes excessively large to reduce the creep strength of the alloy. Furthermore, the hot corrosion resistance of the alloy is aggravated. Accordingly, the content of Al has been limited to 6–11.5%.

B segregates at the grain boundary to increase the strength of the grain boundary at high temperatures, the creep rupture life and rupture elongation of the alloy. To obtain this effect with the alloy of the invention, the amount of B should be at least 0.03%. If it exceeds 0.12%, a low-melting eutectic mixture forms at the grain boundary, and cast alloy articles tend to undergo damage by local melting. Accordingly, the amount of B has been limited to 0.03–0.12%.

Zr, same as B, is an element for strengthening the grain boundary, and is required in an amount of at least 0.01%. If its amount exceeds 0.10%, an intermetallic compound forms in the grain boundary and reduces the creep strength of the alloy. Accordingly, the amount of Zr has been limited to 0.01–0.10%.

In addition to the limited proportions of the individual constituents of the alloy, it is necessary to set up straight conditions pertaining to some elements so as to provide an optimum composition range which will give superior hot corrosion resistance and creep strength.

Investigations of the present inventors led to the discovery that Cr is the most effective element for imparting hot corrosion resistance, and next comes Ti. Ti has an effect 0.6 time that of Cr per unit atomic percent. Accordingly, it is necessary to set a limitation in terms of Cr(%)+0.6Ti(%). In order to impart good hot corrosion resistance to the alloy of the invention, Cr(%)+0.6Ti(%) should be at least 16%.

To increase creep strength, large amounts of W, Ta and Ti should be dissolved to cause solid solution hardening of the $\gamma$-phase and $\gamma'$-phase. The amount required for solid solution hardening can be expressed by Ta(%)+W(%)+0.5Ti (%). In the alloy of the invention, this amount should be at least 3.5%. If it exceeds 7.5%, a detrimental intermetallic compound forms to reduce the creep strength. Hence, Ta(%)+W(%)+0.5Ti(%) has been limited to 3.5–7.5(%).

To increase the creep strength, the amount of the $\gamma'$-phase should be proper. The amount of the $\gamma'$-phase is determined mainly by Al(%)+Ti(%)+Ta(%). If the amount of Al(%)+Ti(%)+Ta(%) is less than 11.5%, the amount of the $\gamma'$-phase precipitated is small, and the creep strength of the alloy is low. If it exceeds 16%, the amount of the eutectic $\gamma'$-phase increases excessively to reduce creep strength. Accordingly, the amount of Al(%)+Ti(%)+Ta(%) is limited to 11.5–16(%).

As shown in Examples to be given hereinbelow, the present invention provides an alloy having far better properties than conventional alloys when their creep strength and hot corrosion resistance are comprehensively evaluated. By using this alloy as a material for blades of gas turbines for jet engines or power generating plants, the temperature of the burning gas can be elevated, and the output and thermal efficiency can be increased.

A second type nickel-base alloy of the invention consists essentially of C 0.2–1.0%, Cr 14–16%, Co 2–13%, W 1.5–2.5%, Ti 4–6%, Al 9–10%, B 0.03–0.12%, Zr 0.01–0.10%, and the remainder being Ni, all percentages being atomic %.

Conventional nickel-base alloys contain a relatively large amount of W and expensive heavy elements such as Ta, Nb and Mo in order to increase creep strength. Hence, they have a high specific gravity, and are expensive. In contrast, this type of the alloy of the invention does not contain these expensive heavy elements except a relatively small amount of W. Accordingly, the alloy of the invention is characterized by a low specific gravity and an advantageous cost.

The reasons for the limitation of the constituents are as follows:

Cr improves hot corrosion resistance, and at the same time, dissolves in a large amount in the $\gamma$-phase to serve for its solid solution hardening. To obtain these effects with the alloy of this invention, the amount of Cr should be at least 14%. If it exceeds 16%, however, the $\sigma$-phase forms to reduce creep strength. Hence, the amount of Cr has been limited to 14–16%.

W dissolves in the $\gamma$-phase and $\gamma'$-phase to serve for marked solid solution hardening of these phases. To obtain this effect with the alloy of this invention, the proportion of W should be at least 1.5%. Its upper limit should be 2.5% in order to prevent the alloy from having a higher specific gravity. Hence, the content of W has been limited to 1.5–2.5%.

Ti dissolves in the $\gamma'$-phase to serve for marked solid solution hardening, and increases the amount of the $\gamma'$-phase to contribute to precipitation hardening of the $\gamma'$-phase. It is also effective for improving hot corrosion resistance. To obtain these effects with the alloy of the invention, the amount of Ti should be at least 4%. However, if it exceeds 6%, the amount of the eutectic $\gamma'$-phase increases excessively to reduce creep strength. Accordingly, the content of Ti has been limited to 4–6%.

Al is an element required for forming the $\gamma'$-phase. Its amount should be at least 9% in order to harden the alloy sufficiently by precipitation. If the amount is more than 10%, the amount of the eutectic $\gamma'$-phase increases excessively to reduce creep strength. Accordingly, the amount of Al has been limited to 9–10%.

The proportions of the other constituents C, Co, B and Zr have been specified for the same reasons as set forth above with regard to the first type alloy. The amount of Co is especially preferably within the range of 10 to 13%.

Investigations of the present inventors led to the discovery that the following three requirements should be met in order for nickel-base alloys to have both hot corrosion resistance and creep strength.

From the standpoint of hot corrosion resistance, Cr(%)+0.6Ti(%) should be at least 16%. To effect solid solution hardening of the $\gamma$-phase and $\gamma'$-phase, W(%)+0.5Ti (%) should be 3.5–7.5%. To obtain precipitation hardening by the $\gamma'$-phase, Al(%)+Ti(%) should be 11.5 to 16%.

However, the alloy composition of the second type of the invention meets all of the three requirements.

A third type nickel-base alloy of this invention consists essentially of C 0.2–1.0%, Cr 12.5–14.5%, Co 2–13%, W 2.4–3.2%, Ti 6–8%, Al 6.5–7.5%, B 0.03–0.12%, Zr 0.01–0.10% and the remainder being Ni, all percentages being atomic %.

This type of alloy is characterized by especially superior hot corrosion resistance, and like the second type alloy, does not contain expensive Ta. It is therefore available at low cost.

The proportions of these constituents of the third type alloy have been limited for the following reasons.

Cr increases hot corrosion resistance and dissolves in a large amount in the $\gamma$-phase to serve for solid solution hardening. To obtain these effects with the alloy of this invention, the amount of Cr should be at least 12.5%. If it exceeds 14.5%, the $\sigma$-phase forms to reduce creep strength. Hence, the content of Cr has been limited to 12.5–14.5%.

W dissolves in the $\gamma$-phase and $\gamma'$-phase to serve for marked solid solution hardening of these phases. To obtain this effect with the alloy of this invention, the amount of W should be at least 2.4%. If it exceeds 3.2%, hot corrosion resistance becomes poor, and a detrimental precipitate such as the $\sigma$-phase forms. Hence, the content of W has been limited to 2.4–3.2%.

Ti mostly dissolves in the $\gamma'$-phase to serve for marked solid solution hardening. Furthermore, it increases the amount of the $\gamma'$-phase to contribute to precipitation hardening. It is also effective for improving hot corrosion resistance. To obtain these effects with the alloy of this invention, the amount of Ti should be at least 6%. If it exceeds 8%, the fluidity of the molten alloy at the time of casting is aggravated, and detrimental intermetallic compounds such as the $\eta$-phase or $\sigma$-phase form. Accordingly, the content of Ti has been limited to 6–8%.

Al is an element required for forming the $\gamma'$-phase. Its amount should be at least 6.5% in order to harden the alloy of this invention sufficiently by precipitation. If it exceeds 7.5%, the amount of the eutectic $\gamma'$-phase increases excessively to reduce creep strength. Accordingly, the amount of Al has been limited to 6.5–7.5%.

The reasons for limiting the proportion of the other constituents C, Co, B and Zr are the same as set forth above with regard to the first type alloy. The amount of Co is especially preferably within the range of 10 to 13%. The range of Cr(%)+0.6Ti(%), W(%)+0.5Ti(%), and Al(%)+Ti(%) are the same as those described above with regard to the second type alloy.

EXAMPLE

Compositions of alloys:

Some examples of the composition of a nickel-base alloy of this invention are shown in Table 1. Alloys of code Nos. 38, 44, 46, 47, 48, 54, 55, 65 and 66 belong to the first type; code No. 39, to the second type; and code No. 49, to the third type.

Table 1 also gives the compositions of the five typical conventional nickel-base alloys which are described hereinabove.

Table 1

| | Alloy code No. | C | Cr | Co | W | Ti | Ta | Nb | Mo | Al | B | Zr | Ni |
|---|---|---|---|---|---|---|---|---|---|---|---|---|---|
| Alloys of the invention | 38 | 0.55 | 15.3 | 4.0 | 2.1 | 3.4 | 0.8 | 0 | 0 | 10.5 | 0.06 | 0.06 | Balance |
| | 44 | 0.55 | 14.4 | 5.9 | 2.8 | 3.4 | 1.6 | 0 | 0 | 8.9 | 0.06 | 0.06 | " |
| | 46 | 0.55 | 14.8 | 6.5 | 2.1 | 4.7 | 1.6 | 0 | 0 | 7.9 | 0.06 | 0.06 | " |
| | 47 | 0.55 | 14.5 | 9.5 | 2.8 | 4.8 | 0.8 | 0 | 0 | 8.1 | 0.06 | 0.06 | " |
| | 48 | 0.55 | 14.1 | 12.1 | 2.1 | 6.1 | 0.8 | 0 | 0 | 7.1 | 0.06 | 0.06 | " |
| | 54 | 0.55 | 12.6 | 2.2 | 3.5 | 6.1 | 0.9 | 0 | 0 | 7.1 | 0.06 | 0.06 | " |
| | 55 | 0.55 | 13.8 | 8.7 | 2.8 | 6.8 | 0.9 | 0 | 0 | 6.3 | 0.06 | 0.06 | " |
| | 65 | 0.55 | 15.8 | 10.0 | 2.8 | 4.5 | 0.8 | 0 | 0 | 7.6 | 0.06 | 0.06 | " |
| | 66 | 0.55 | 13.2 | 2.4 | 2.8 | 7.5 | 0.3 | 0 | 0 | 6.8 | 0.06 | 0.06 | " |
| | 39 | 0.55 | 15.0 | 11.1 | 2.1 | 4.8 | 0 | 0 | 0 | 9.3 | 0.06 | 0.06 | " |
| | 49 | 0.55 | 13.5 | 11.7 | 2.8 | 6.9 | 0 | 0 | 0 | 6.9 | 0.06 | 0.06 | " |
| Conventional alloys | Mar-M 200 | 0.74 | 10.2 | 10.0 | 4.0 | 2.5 | 0 | 0.7 | 0 | 11.0 | 0.08 | 0.03 | " |
| | Mar-M 246 | 0.73 | 10.2 | 10.0 | 3.2 | 1.8 | 0.5 | 0 | 1.5 | 12.0 | 0.08 | 0.03 | " |
| | IN-792 | 0.58 | 13.9 | 8.9 | 1.2 | 5.5 | 1.3 | 0 | 1.2 | 6.7 | 0.11 | 0.06 | " |
| | Rikiloy 481 | 0.76 | 7.1 | 10.4 | 4.7 | 7.7 | 0 | 0 | 1.3 | 6.8 | 0.09 | 0.03 | " |
| | Rikiloy 3757 | 0.74 | 15.9 | 10.0 | 3.2 | 4.9 | 0 | 0 | 0.6 | 6.6 | 0.08 | 0.03 | " |

Properties of alloys:

The creep strengths and hot corrosion resistances of the alloys of the invention and the conventional alloys described in Table 1 are shown in Table 2.

Creep rupture test: An alloy was melted in a high frequency vacuum melting furnace, and cast into a lost wax mold maintained at 800° C. Thus, a rod-like test piece having a diameter of 6 mm was made. The as-cast test piece was used in the creep rupture test. At 1000° C. and 12 kg/mm$^2$, the rupture life (hours) of the test piece was measured.

Hot corrosion test: A cylindrical test piece, 6 mm in diameter and 4.5 mm in length, of an alloy was dipped for 20 hours in a molten salt kept at 900° C. consisting of 75 % by weight of $Na_2SO_4$ and 25 % by weight of NaCl, and the weight loss of the test piece owing to corrosion was measured. From the weight loss, the thickness (mm) of the alloy lost at each surface of the cylindrical test piece was calculated.

Table 2

| Alloy code No. | Rupture life (hr) at 1000° C. 12 kg/mm$^2$ | Metal loss (mm) after 20 hours |
|---|---|---|
| 38 | 241.4 | $2.31 \times 10^{-1}$ |
| 44 | 322.8 | 1.05 |
| 46 | 344.1 | $6.32 \times 10^{-1}$ |
| 47 | 398.7 | $2.68 \times 10^{-1}$ |
| 48 | 244.1 | $1.05 \times 10^{-1}$ |
| 54 | 233.8 | $3.31 \times 10^{-1}$ |
| 55 | 199.1 | $5.05 \times 10^{-4}$ |
| 65 | 283.3 | $3.59 \times 10^{-2}$ |
| 66 | 208.8 | $4.30 \times 10^{-4}$ |
| 39 | 202.5 | $4.99 \times 10^{-2}$ |
| 49 | 207.4 | $1.90 \times 10^{-4}$ |
| Mar-M 200 | 206.1 | $8.95 \times 10^{-1}$ |
| Mar-M 246 | 395.3 | 4.83* |
| IN-792 | 180 (a) | $1.26 \times 10^{-3}$ |
| Rikiloy 481 | 250 (b) | >1.50 (b) |
| Rikiloy 3757 | 170 (b) | $2.00 \times 10^{-1}$ (b) |

*Since the rate of corrosion was very high, the test results obtained during a period of 3 hours were converted to these which would be obtainable during a period of 20 hours.

(a) Data described in Metal Progress, MID-JUNE (1976), page 109.

(b) Value calculated from the data described in R. Watanabe and T. Kuno: J. of Iron and Steel Inst., Japan, vol. 61 (1975), p. 126.

FIG. 1 is a graphic representation plotting the results shown in Table 2. The axis of ordinates represents the rupture lives (hours) of alloys, and the axis of abscissas, the thickness (mm) of metal loss by hot corrosion for 20 hours. The indication above the axis of abscissas shows times (hours) corresponding to a metal loss of 0.1 mm thickness. Hence alloys which are situated more in an upper and left-hand side region in the graph are desirable alloys. In FIG. 1, the conventional five typical nickel-base alloys are shown by black circles, and a line connecting them is shown. It will be seen that the alloys of the invention are located in the desirable region as compared with the conventional alloys.

Evaluation of the alloys of this invention:

From an overall consideration of creep strength and hot corrosion resistance, the alloys of the present invention are superior to the conventional typical nickel-base alloys.

The especially noteworthy characteristics of the alloys in the above examples are as follows:

Alloy of code No. 47 is characteristic in that its creep strength is especially high. It has about twice as long a creep rupture life as Mar-M200 which is most frequently used in turbine blades in jet engines. Furthermore, it has about 3 times as high resistance to hot corrosion.

Alloys of codes Nos. 49, 55 and 66 are characteristic in that they have an especially high resistance to hot corrosion. The hot corrosion resistance of alloy 49 is about 7 times as high as that of IN-792 which is known to have the highest hot corrosion resistance. The hot corrosion resistances of alloys 55 and 66 are about 2 to 3 times as high as that of IN-792. These three alloys have higher creep strength than IN-792.

Alloy of code No. 39 contains a relatively small amount of W but does not contain expensive elements such as Ta, Nb and Mo, and therefore has the advantage that it has a relatively low specific gravity, and is cheap. Its low specific gravity is advantageous for use as a material for blades which undergo centrifugal force. This alloy has far higher hot corrosion resistance than Mar-M200, and its creep strength is substantially equivalent to that of Mar-M200.

It is seen from Table 2 and FIG. 1 that the other alloys of the invention are superior to the conventional alloys from an overall consideration of creep strength and hot corrosion resistance.

What we claim is:

1. A nickel-base alloy consisting essentially of C 0.2–1.0%, Cr 12–16.5%, Co 2–13%, W 1.5–3.6%, Ti 2.5–8%, Ta 0.1–2.0%, Al 6–11.5%, B 0.03–0.12%, Zr 0.01–0.10%, and the remainder being Ni, wherein $Cr\% + 0.6Ti\% \geqq 16\%$, $Ta\% + W\% + 0.5Ti\% = 3.5\text{–}7.5\%$, and $Al\% + Ti\% + Ta\% = 11.5\text{–}16\%$, all percentages being atomic percent.

2. A nickel base alloy consisting essentially of C 0.2–1.0%, Cr 14–16%, Co 2–13%, W 1.5–2.5%, Ti 4–6%, Al 9–10%, B 0.03–0.12%, Zr 0.01–0.10%, and the remainder being Ni, all percentages being atomic %.

3. A nickel base alloy consisting essentially of C 0.2–1.0%, Cr 12.5–14.5%, Co 2–13%, W 2.4–3.2%, Ti 6–8%, Al 6.5–7.5%, B 0.03–0.12%, Zr 0.01–0.10%, and the remainder being Ni, all percentages being atomic %.

4. An alloy according to claim 2, wherein the Co is present in an amount of 10–13 atomic %.

5. An alloy according to claim 3, wherein the Co is present in an amount of 10–13 atomic %.

* * * * *